United States Patent [19]

Portz et al.

[11] Patent Number: 4,680,064

[45] Date of Patent: Jul. 14, 1987

[54] PHOSPHATE CONVERSION COATING ACCELERATORS

[75] Inventors: Heinz Portz, Roesrath-Kleineichen; Othmar V. Ettingshausen, Duesseldorf, both of Fed. Rep. of Germany

[73] Assignee: Gerhard Collardin GmbH, Cologne, Fed. Rep. of Germany

[21] Appl. No.: 781,316

[22] Filed: Sep. 27, 1985

Related U.S. Application Data

[63] Continuation of Ser. No. 631,022, Jul. 16, 1984, abandoned.

[30] Foreign Application Priority Data

Jul. 19, 1983 [DE] Fed. Rep. of Germany ..... 3325974

[51] Int. Cl.[4] ..... C23C 22/12

[52] U.S. Cl. ..... 148/617; 148/6.15 Z

[58] Field of Search ..... 148/6.17, 6.15 Z, 6.15 R

[56] References Cited

U.S. PATENT DOCUMENTS

| | | | |
|---|---|---|---|
| 3,520,737 | 7/1970 | Gerassimoff et al. | 148/6.15 |
| 3,923,554 | 12/1975 | Ziemba | 148/6.15 Z |
| 4,149,909 | 4/1979 | Hamilton | 148/6.15 R |
| 4,292,096 | 9/1981 | Murakami et al. | 148/6.15 Z |
| 4,419,147 | 12/1983 | Murakami et al. | 148/31.5 |
| 4,419,199 | 12/1983 | Hauffe et al. | 204/181 R |

FOREIGN PATENT DOCUMENTS

| | | | |
|---|---|---|---|
| 2241798 | 3/1974 | Fed. Rep. of Germany . | |
| 2232067 | 5/1980 | Fed. Rep. of Germany . | |
| 1360266 | 7/1974 | United Kingdom . | |
| 1542222 | 3/1979 | United Kingdom . | |
| 2074611 | 11/1981 | United Kingdom . | |
| 2102839 | 2/1983 | United Kingdom . | |
| 550460 | 4/1977 | U.S.S.R. | 148/617 |

*Primary Examiner*—Sam Silverberg

*Attorney, Agent, or Firm*—Henry E. Millson, Jr.; Mark A. Greenfield; Real J. Grandmaison

[57] ABSTRACT

Phosphate conversion coating accelerators consisting essentially of amidosulfonic acid, N-substitution products and salts thereof, sulfonamides, 1,2,3-oxathiazin-4(3H)-one salts or 6-alkyl derivatives thereof, and ortho-aniline sulfonic acid or its derivatives aklyl-substituted on the ring and salts thereof, and mixtures of the foregoing, and a process for their use.

36 Claims, No Drawings

PHOSPHATE CONVERSION COATING ACCELERATORS

This application is a continuation of application Ser. No. 631,022, filed 7/16/84 now abandoned.

BACKGROUND OF THE INVENTION

1. Field of the Invention

This invention relates to accelerators and a process for their use in the layer-refining application of phosphate coatings to metal surfaces by means of phosphating solutions based on zinc phosphate and/or iron phosphate and/or zinc-iron phosphate as the principal layer-forming component.

2. Description of the Related Art

It has long been known that iron phosphate layers can be formed on iron and steel surfaces. Alkali and/or ammonium orthophosphate solutions having a pH of from 3.0 to 6.5 are used for this purpose ("non-layer-forming phosphating").

Processes by which zinc phosphate layers are formed on metal surfaces are also known ("layer-forming phosphating"). Layers such as these improve corrosion prevention and lacquer adhesion. Earlier processes required high reaction temperatures and a considerable treatment time for layer formation. The layer-forming process can be shortened by the addition of accelerators. Above all, oxidizing agents, such as nitrate, nitrite, chlorate, hydrogen peroxide and organic nitro compounds, play an important role as accelerators.

Thus, British Patent Application No. 2,074,611 and corresponding German Patent Application No. 30 16 576 describe a process for accelerating the formation of phosphate layers based on zinc phosphate, the solution applied containing nitrite and chlorate as accelerators. A process based on a solution of zinc phosphate uses a combination of chlorate and a water-soluble aromatic nitro compound, preferably Na-m-nitrobenzene sulfonate, as accelerator (see British Patent Application No. 2,102,839 and corresponding German Patent Application No. 32 24 923). A comparable combination is claimed in British Patent No. 1,542,222.

U.S. Pat. Nos. 4,292,096 and 4,419,147 as well as corresponding German Patent Application No. 30 04 927 also describe a process for forming phosphate layers on metal surfaces using zinc phosphate solutions containing nitrite and/or organic nitro compounds and, optionally, also chlorate.

Moreover, the use of water-soluble aromatic nitro compounds in accelerator systems for phosphating processes, during the reaction with the metal surface, leads to serious discoloration of the phosphating solutions and also to the formation of voluminous sludge. Both disadvantages make the process difficult to carry out and necessitate permanent "restrengthening", i.e. readjustment of the contents of the solutions.

In addition, it is known from U.S. Pat. No. 3,923,554 that comparatively thick phosphate layers can be formed on metal surfaces. These layers reduce frictional resistance during cold-forming. Phosphate coatings such as these weigh between 10.0 and 22.0 g per square meter. The formation of coatings such as these requires treatment times of several hours and treatment temperatures in the range from 90° to 95° C. In this case, formation of the coating is accelerated by nitrites. U.S. Pat. No. 3,923,554 describes a process in which layer formation is accelerated by the addition of up to 2 g/l of sodium nitrite. However, since nitrite concentrations as high as these in the solutions applied interfere with formation of the phosphate coating through passivation of the metal surfaces, excesses of nitrite are bound—according to U.S. Pat. No. 3,923,554—by means of urea, its adducts and also sulfamic acid, ascorbic acid or hydroxyl amine. These substances thus prevent the nitrite-induced passivation of the metal surface.

The nitrite content of the phosphating solution is generally adjusted to at most 0.1 g/l. In many cases, nitrite concentrations of this order in the treatment solution are sufficient to obtain the formation of phosphate coatings on metal surfaces. In addition, a number of factors, for example the temperature of the phosphating solution, the available oxygen, the reactivity of the metal surfaces to be treated, mechanical agitation of the phosphating solution, the spraying pressure and the pH-value, influence the effect of nitrite on the formation of the phosphate coating. It follows from this that, in the presence of nitrite, the performance of the bath depends upon a number of intricately interrelated factors.

Another factor to be taken into account is that phosphating solutions frequently contain nitrate. Carrying out the phosphating process at elevated temperature in the presence of nitrates as oxidizing agents leads increasingly to autoreduction of the nitrate with formation of more nitrite. The formation of this additional nitrite is difficult to control and undesirable, because, as mentioned above, passivation of the metal surfaces occurs to an increasing extent.

One particular disadvantage lies in the fact that the use of nitrite-containing systems for accelerating phosphating solutions leads to the release of physiologically harmful nitrous gases. This disadvantage makes it advisable to avoid using nitrite or even nitrate as phosphating accelerators or to carry out the reaction under such conditions that no nitrite is formed.

Adjustment and maintenance of the pH are crucially important to the formation of a good phosphate coating. The pH may be in the range from 1.8 to 5.8 and is preferably adjusted to the required level by means of phosphoric acid. However, sulfamic acid (see British Patent No. 1,360,266 or corresponding German Patent Application No. 21 52 446) and a combination of sulfamic acid and phosphoric acid have also been used for this purpose. Due to the lower acidity of the organic component, however, the concentrations required are distinctly higher (up to 9.5% by weight, based on the solution applied) than is the case where phosphoric acid alone is used.

Further disadvantages of the above processes are that the various weights per unit area in which the phosphate coating can be applied are difficult to control and that the phosphate coatings obtained are not sufficiently fine-grained for effective lacquer adhesion. In addition, it is not possible in the above processes to adjust specific coating weights and grain sizes by altering simple parameters or to control the formation of phosphate coatings as a function of temperature.

Thick and fully developed phosphate coatings with weights per unit area of from 10 to 35 g/m$^2$ are required for corrosion prevention and for lubricant carriers in cold forming operations. Weights per unit area as high as these are normally obtained at phosphating bath temperatures of from 70° to 100° C. German Patent Application No. 22 41 798 describes one such nitrate-accelerated immersion process in which the ratio by weight of $P_2O_5$ to Zn to $NO_3$ has to be adjusted to 1:(0.7–2.0):(0.3–0.7). German Patent Application No. 15 21 927 also claims a nitrate-accelerated process in which the ratio by weight of $P_2O_5$ to Zn to $NO_3$ is disclosed as 1:(1.4–2.6):(2.0–4.3). In both processes, a small addition of sodium nitrite during preparation of the bath has to be made to "initiate" the phosphating solution. The continued formation of nitrite which is required for the formation of a phosphate coating on the metal surface takes place autocatalytically from nitrate. As a result, the iron (II) entering the bath during the throughput of iron and steel is in danger of being oxidized to a significant extent into iron (III), resulting in precipitation and undesirable sludge formation.

In practice, soaps in conjunction with phosphate layers are used as lubricants in cold forming. The zinc phosphate layers on the workpiece may be partly reacted with alkali soaps in such a way that particularly effective zinc soaps are formed. In this case, the tertiary zinc phosphate of the layer reacts with sodium soap to form zinc soap and tertiary sodium phosphate. For the reaction, the phosphated workpieces are immersed in a soap bath for 2 to 10 minutes at 70° to 80° C. The highest degree of reaction and therefore the best forming results are obtained with special reactive soap lubricants, and immersion baths mixed with quantities of from 2 to 10% by weight have a pH of from 8 to 10.

The formation of the phosphate coatings may be influenced by special prerinses. With prerinses of the type in question, it is frequently possible to eliminate the layer-degrading effects of preceding treatments, for example alkaline degreasing or pickling. Because of this, prerinses of the type in question are widely applied in practice.

Zinc phosphating processes based on low-zinc technology are also in use. Low-zinc technology is a variant which differs from normal zinc technology in certain significant aspects. These differences lie in particular in the concentrations in which the determining bath components, zinc and phosphate, are present in the treatment solution and in the molar and weight ratios of these two components to one another. Whereas in normal zinc phosphating baths the weight ratio of zinc to phosphate is approximately 1:(1–12), the weight ratio in low-zinc phosphating baths is approximately 1:(14–30).

German Patent Application No. 22 32 067 discloses that low-zinc technology in particular leads to phosphate coatings on metal which are superior to those obtained by normal zinc technology with regard to both lacquer adhesion and corrosion prevention. However, low-zinc phosphating processes are attended by disadvantages, above all regarding the management of the phosphating baths. The phosphating rate is lower in the low-zinc phosphating process, so that the throughputs are correspondingly lower. The bath components in the phosphating bath are consumed in a ratio to one another which differs significantly from the ratio in which they are present in the bath itself. Because of this, phosphating concentrates differing significantly in their composition are required according to U.S. Pat. No. 4,419,199 and corresponding European Patent Application No. 64,790, both for preparing and for replenishing the bath. In addition, phosphating baths are relatively difficult to monitor, especially since the ratio of chemical consumption to mechanical erosion, (which in turn depends among others upon the shape of the metal workpiece being treated, upon the drainage facilities and also upon the type of phosphating plant used), does not represent a constant value.

SUMMARY OF THE INVENTION

The present invention provides a process for the accelerated and layer-refining application of phosphate coatings to metal surfaces which does not have any of the disadvantages referred to in the foregoing. More particularly, the invention provides a process which does not involve the use of nitrite as an accelerator component and which, even in normal zinc technology, produces the same results with regard to lacquer adhesion and corrosion prevention as those obtained in low-zinc technology. In addition, the invention facilitates bath management by simplifying monitoring of the contents of the individual accelerator components and reducing the accumulation of sludge in the phosphating baths. The invention also enables environment-friendly, toxicologically acceptable compounds to be used in the new process.

More specifically, this invention relates to the use of amidosulfonic (sulfamic) acid, N-substitution products and salts thereof, sulfonamides, 1,2,3-oxathiazin-4(3H)-one salts or 6-alkyl derivatives thereof and 2 (i.e., ortho)-aniline sulfonic acid or its derivatives alkyl-substituted on the ring and salts thereof, either individually or in combination, as accelerating components in addition to other components of the type normally used in phosphating solutions.

In particular, the metal surfaces being treated are brought into contact with a phosphating solution containing accelerator compounds having the following formulas, or any mixture thereof.

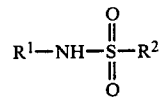

(I)

wherein:

$R^1$ is (i) hydrogen, (ii) a $C_{1-4}$ linear or branched alkyl radical, (iii) a $C_{5-6}$ saturated carbocyclic or heterocyclic radical, or (iv) an aryl or aralkyl radical having at least 6 members; and $R^2$ is (i) hydroxy, (ii) $-O^{-M+}$ in which M+ is an alkali metal or an ammonium ion, or (iii) an aromatic ring having at least 6 members, optionally substituted by a hydroxy, amino, ($C_{1-3}$ alkyl)—CO—NH or (carboxy $C_{1-3}$ alkyl-)—CO—NH radical.

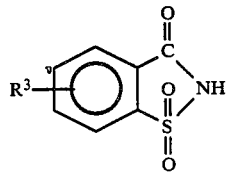

(II)

wherein:

$R^3$ is (i) hydrogen, (ii) hydroxy, or (iii) an amino radical.

(III)

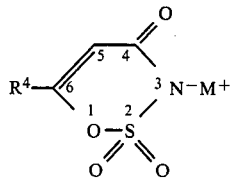

wherein:

$R^4$ is (i) hydrogen, or (ii) a $C_{1-4}$ linear or branched alkyl radical.

$M^+$ is an alkali metal or an ammonium ion.

(IV)

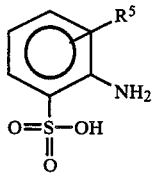

wherein:

$R^5$ is (i) hydrogen, or (ii) a $C_{1-4}$ linear or branched alkyl.

The alkali metal or ammonium salts of the compounds of formulas (I), (II) and (IV) may also be used as it is preferred for these compounds to be water soluble.

The above compounds, or mixtures thereof, are used in a quantity of from 0.1 to 6 g/l as an accelerating and layer-refining component in addition to other components of the type normally used in phosphating solutions. Moreover, the compounds are so versatile that they may be considered as universally usable.

DETAILED DESCRIPTION OF THE INVENTION

In preferred embodiments, the compounds of general formulas (I), (II), (III) and (IV) according to the invention are used in combination with m-nitrobenzene sulfonic acid as a coaccelerator. This results in particularly effective acceleration of the phosphating process.

In addition to the compounds according to the invention, nitrates and, where compounds corresponding to general formulas (III) and (IV) are present, even nitrites may also be used as coaccelerators. However, it is regarded as especially advantageous in the context of the invention not to add nitrite as an accelerating component where the compounds according to the invention are used, and it preferably should be avoided.

Amidosulfonic acid and/or N-substituted derivatives thereof and also the water-soluble salts of these compounds and/or benzoic acid sulfimide and/or benzene sulfonanilide and/or 1,2,3-oxathiazin-4(3H)-one salts and/or 6-alkyl derivatives thereof and/or 2-aniline sulfonic acid and/or 3-toluidine-4-sulfonic acid and water-soluble salts thereof are used in preferred embodiments of the invention. Other sulfonamides are also suitable, particularly those with an aromatic radical which contains other polar radicals which improve the solubility of the compounds in water, such as hydroxy or amino radicals or amido radicals of dicarboxylic acids.

The solubility in water of the compounds according to the invention should be so good that at least 2 g of the compounds corresponding to general formulas (I), (II), (III) and/or (IV) dissolve in 1 liter of phosphating solution. This result is generally achieved by using water-soluble salts, preferably alkali metal salts, of amidosulfonic acid and/or N-substituted derivatives thereof and/or other compounds containing as substituents polar groups which improve the solubility in water.

The active constituents of the phosphating solution may be introduced into water in known manner in the form of water-soluble or acid-soluble salts or compounds or in the form of acids. For example, it is possible to use sodium dihydrogen phosphate, ammonium dihydrogen phosphate, zinc nitrate, zinc oxide, zinc carbonate, acidic zinc phosphate, nickel carbonate, iron nitrate, alkali chlorate and phosphoric acid. Phosphate layers characterized by high weights per unit area may be formed in either the presence or the absence of the auxiliary accelerator chlorate in the process according to the invention. In the presence of chlorate, it is even possible to use small additions of the further auxiliary accelerator molybdate.

Optimum formation of the phosphate coating in terms of subsequent organic coating adhesion and corrosion protection is obtained if chlorate is used as an auxiliary accelerating component and the weight ratio of the accelerator compounds of formulas (I), (II), (III) and/or (IV) to chlorate ($ClO_3$) is adjusted to about (0.1–10):1. Where molybdate is present as an auxiliary accelerating component in the phosphating solution, another preferred embodiment of the invention leads to optimal formation of the phosphate coating when the weight ratio of the compounds of general formulas (I), (II), (III) and/or (IV) to molybdate ($MoO_4$) is about (10–100):1.

The accelerators and process according to the invention are particularly suitable for the formation of phosphate coatings on steel, galvanized steel, aluminum or on surfaces containing several of these metals. They are advantageously used for the formation of phosphate coatings which are suitable both as anti-corrosion layers and layers for improving lacquer adhesion and also as lubricating layers for cold forming work.

If desired, the phosphating solution may contain other components. Thus, it is of advantage for phosphating aluminum surfaces to use solutions additionally containing from 0.1 to 0.5 g/l of fluoride which may be present in the phosphating solution as a free or complexed fluoride ion. Suitable complex fluorides are, for example, fluoroborates and fluoro-silicates.

For forming phosphate coatings on galvanized steel, it is of advantage to use phosphating solutions which additionally contain Ni, Co and/or Fe ions. However, these ions should be present in a total quantity of no more than 3.0 g/l. Salts of these metals are best used in a concentration of from 0.1 to 4.5 g/l of the simple or complex fluorides mentioned above. Phosphating solutions containing nickel, cobalt and/or iron and also fluoride are particularly suitable for forming phosphate coatings on surfaces consisting of several metals. In that case, however, the total quantity of nickel, cobalt and/or iron ions should be no greater than the quantity of zinc ions. Using an acidic zinc phosphate solution, a weight ratio of zinc to phosphate of 1:1–12 is preferred.

The effectiveness of sulfamic acids and derivatives thereof is impaired in phosphating solutions containing calcium ions. According to the invention, therefore, accelerators which do not contain any substantially insoluble calcium salts, for example benzoic acid sulfimide or benzene sulfanilides, are used in phosphating solutions such as these.

The pH of the phosphating solution should be between about 1.8 and 5.8 and preferably between about 2.0 and 3.5. The free acid and the total acid may be determined by potentiometric titration or by titration against phenol phthalein (total acid) and bromcresol green (free acid) with aqueous 0.1 N sodium hydroxide solution and should amount to between about 5 and 30 (total acid) points and to between about 0.1 and 2.5 (free acid) points (=ml of 0.1 N NaOH).

The process and accelerators according to the invention have the advantage that, with a total acid content of less than 40 points and a free acid content of less than 20 points, they produce well-formed phosphate coatings of up to 30 g/m$^2$ on metal surfaces which are subsequently subjected to cold forming.

The treatment of the metal surfaces to form homogeneous phosphate coatings may be carried out in any way known in the art. Immersion coating, spray coating, and combined immersion/spray coating systems are particularly suitable. The treatment times are between about 20 and 300 seconds and preferably between about 30 and 180 seconds. In the immersion process, well-developed phosphate coatings of up to 22 g/m$^2$ are formed after only up to 300 seconds. The treatment times depend upon the process conditions (temperature of the phosphating solutions, pH-value, spraying pressure), upon the condition of the metal surfaces to be phosphated, and upon the pretreatment of the metals to be phosphated.

The temperatures at which the metal surfaces may be brought into contact with phosphating solutions using the accelerators according to the invention are from about 25° to 70° C. and, for the formation of phosphate coatings having high weights per unit area, are preferably from about 45° to 60° C. These are considerably below the treatment temperatures normally applied. Treatment temperatures of 25° C. are possible in special process combinations and specially formulated phosphating solutions.

The inventive process has the further advantage that sludge formation is largely suppressed. As a fortunate result of the lower treatment temperatures, incrustation of the heating registers is almost completely avoided. There is considerably less sludge formation in the bath than in the known phosphating baths which use continuous or several daily additions of sodium nitrite as the accelerator. With immersion coating and normal throughputs, baths according to the invention need only be desludged every 12 to 15 months.

The process according to the invention affords the further advantage that excellent lacquer adhesion and corrosion prevention are obtained even when otherwise normal-quantity zinc phosphating technology is used. Surprisingly, the advantages of normal-quantity zinc phosphating technology in process terms may be combined with the advantages of low-quantity phosphating technology in regard to practical application.

The process according to the invention also produces the new and surprising effect that the zinc phosphate baths may be operated immediately, i.e., without having to be run in, at very high bath loads and low temperatures. In addition, the required phosphate coatings may be produced particularly economically by virtue of the low consumption of chemicals required for obtaining a certain layer weight.

Using the process and accelerators according to the invention, it is possible to obtain coating weights of from 0.2 to 30 g/m$^2$ on ungalvanized steel and from 0.5 to 3.0 g/m$^2$ on galvanized steel. The particular value is determined by the method of treatment, by the treatment time, by the accelerator concentration and by the temperature of the phosphating solutions applied. One particular advantage of the inventive process and accelerators is that using the same process parameters, the coating weights may be varied within the limits indicated by varying the treatment temperature. Accordingly, higher coating weights may be obtained by increasing the phosphating temperature. This effect is particularly pronounced at temperatures in the range from about 45° to 60° C.

The process according to the invention is carried out in a sequence known in the art which comprises cleaning the metal surfaces, rinsing with water, optionally preactivating with a solution containing titanium salts, phosphating to form the phosphate coating, rinsing with water, aftertreatment (passivation) and rinsing with fully deionized water.

Another characteristic feature of the process is that there is no need for preactivation using a solution containing titanium salts. In that case, the process sequence comprises cleaning with a strongly alkaline cleaner, rinsing, phosphating to form the phosphate coating, aftertreatment (passivation) and rinsing with fully deionized water.

The processes accelerated in accordance with the invention using the compounds of general formulas (I), (II) (III) and (IV) as one accelerating component give phosphate coatings which are very fine-grained. By varying the accelerator ratio and the treatment times and, in particular, by varying the treatment temperatures, it is possible to vary the quality of the phosphate coatings in terms of weight and fineness to meet particular requirements.

The fine-grained phosphate coatings afford outstanding protection against corrosion, as was revealed by testing by the methods described in the examples which follow. It was also found that the fine phosphate coatings in particular form an outstanding anchorage for subsequently applied lacquer coatings. The process according to the invention is especially advantageous as a pretreatment before electrodeposition, particularly cathodic electrodeposition. However, the metal surfaces coated with the phosphate layers can not only by lacquered, they can also be coated with other materials.

Another important advantage is that since there is less sludge and crust formation in the phosphating systems, the process can be carried out economically and the useful life of the phosphating solution is extended.

The phosphating solution used in the inventive process is normally prepared as a concentrate and diluted before use. The content of free acid in the concentrate may be high enough to avoid any deposition of solids during storage or transport or in the event of a reduction in temperature. In practical application (i.e., during the preparation and regeneration of the layer-forming phosphating bath), the concentrate is diluted to the requisite concentration and, at the same time, adjusted to the necessary pH or free acid content. The continuously used phosphating solution may be regenerated by a single regeneration solution containing all the active constituents or by several regeneration solutions which, together, contain all the active constituents.

EXAMPLES

The invention is illustrated by the following examples in which the following tests were carried out to determine the adhesion of a lacquer subsequently applied to the phosphated plates and to determine corrosion resistance. The accelerators according to this invention are identified as "(ACCELERATOR/S)".

A. Lacquer adhesion

1. Cross hatching, DIN 53 151
2. Erichsen indentation, DIN ISO 15 20
3. Mandrel bending test, DIN 53 152

B. Corrosion tests

1. Salt spray test, DIN 50 151
(a) with a single cut, evaluation in accordance with DIN 53 167
(b) scab blistering, evaluation in accordance with DIN 53 209
(c) degree of rusting, evaluation in accordance with DIN 53 210
2. Chipping test according to VW Test No. 3.17.1. of 6.1.1981, evaluation on the basis of appearance (photo-comparison 1 to 10)
3. Condensation test according to DIN 50 017.
4. Alternating climate test according to VW Test P-VW-1210.

EXAMPLE 1

A powder-form mixture (concentrate A) was initially prepared in a suitable mixer from

| | |
|---|---|
| $NaH_2PO_4$ (pyrophosphate-free) | 90.5 parts by weight |
| benzoic acid | 3.1 parts by weight |
| $H_3PO_4$ (85%) | 3.8 parts by weight |
| triethanolamine | 2.6 parts by weight |

Providing the steel is not heavily soiled, the chelating agent, triethanolamine, need not be added. In that case, the values for the remaining constituents of concentrate A are increased accordingly, totalling 100 parts by weight.

A surfactant mixture (concentrate B) was prepared in a container by stirring the following ingredients together:

| | |
|---|---|
| water | 80.0 parts by weight |
| ethylene diamine 30 EO/60 PO | 12.0 parts by weight |
| alkyl phenol 10 EO/9 PO | 6.5 parts by weight |
| cocoamine 12 EO | 1.5 parts by weight |

A phosphating solution intended for the spray-coating of metal plates was prepared from both concentrates by mixing 10.0 g/l of concentrate A and 2.0 g/l of concentrate B in water. 0.2 g/l of amidosulfonic acid and 0.8 g/l of N-cyclohexyl sulfamic acid (ACCELERATORS) were added to the resulting mixture. The pH of the resulting solution was 3.6.

Using the solution prepared in this way, cold-rolled steel plates were cleaned, degreased and coated with iron phosphate in a single operation carried out at temperatures of 40°, 50° or 60° C. In each case, the treatment time was 180s.

The weights of the phosphate coatings applied are shown in the following table as a function of the treatment temperature.

TABLE

Coating weights as a function of the treatment temperature:

| Treatment temperature (°C.) | Coating weights (g/m$^2$) |
|---|---|
| 40 | 0.2–0.3 |
| 50 | 0.7–0.9 |
| 60 | 0.9–1.2 |

The plates were then rinsed for 30 seconds with cold water. They were then spray-coated for 30 seconds at room temperature with a solution containing Cr(VI)/Cr(III) ions which had a pH of 4.0. Thereafter, the plates were spray-rinsed for 10s with fully deionized water. Finally, the plates were oven-dried for 5 minutes at 130° C.

The plates thus phosphated were then subjected to cathodic electrodeposition using an electrodeposition lacquer. Thereafter, the plates were tested to determine their corrosion resistance and various other physical properties. The results obtained were all excellent.

EXAMPLE 2

A powder-form mixture was initially prepared from the following components:

| | |
|---|---|
| $NaH_2PO_4$ | 81.0 parts by weight |
| $NH_4H_2PO_4$ | 9.8 parts by weight |
| $Na_2MoO_4.H_2O$ | 0.3 parts by weight |
| $H_3PO_4$ (85%) | 2.0 parts by weight |
| ethylene diamine 30 EO/60 PO | 4.4 parts by weight |
| alkyl phenol 10 EO/9 PO | 2.0 parts by weight |
| cocoamine 12 EO | 0.5 parts by weight |

This powder-form mixture was dissolved in water in a concentration of 10.0 g/l 0.2 g/l of amidosulfonic acid and 0.8 g/l of the sodium salt of N-cyclohexyl sulfamic acid (ACCELERATORS) were then added to the resulting solution. The pH of the solution thus prepared was 3.8.

Using the solution prepared in this way, galvanized steel plates were cleaned, degreased and spray-coated with a layer of phosphate in a single operation carried out at 50° C. The treatment time was 120s. The plates thus spray-coated were then rinsed with cold water for 30 seconds, followed by spraying for 30 seconds at room temperature with a solution containing Cr(VI)/Cr(III) ions which had a pH of 4. Thereafter, the plates were spray-rinsed for 10 seconds with fully deionized water, followed by oven-drying for 5 minutes at 30° C.

The galvanized steel plates treated as described above were knife-coated with a coil coating lacquer. The steel plates were then tested to determine corrosion resistance and lacquer adhesion. The results obtained were all excellent.

EXAMPLE 3

A concentrate A was initially prepared by mixing the following ingredients in a container of plastic or stainless steel:

| | |
|---|---|
| water | 32.5 parts by weight |
| $H_3PO_4$ (75%) | 47.8 parts by weight |
| ZnO | 8.5 parts by weight |
| $NiCO_3$ | 5.6 parts by weight |
| NaOH (50%) | 1.4 parts by weight |
| $FeSO_4.7H_2O$ | 0.2 parts by weight |
| $NaClO_3$ | 4.6 parts by weight |

In a second container, a concentrate B was prepared by stirring the following ingredients together:

| | |
|---|---|
| water | 26.1 parts by weight |
| $H_3PO_4$ (75%) | 31.3 parts by weight |
| $NiCO_3$ | 5.6 parts by weight |
| NaOH (50%) | 14.0 parts by weight |
| $NaClO_3$ | 3.0 parts by weight |
| amidosulfonic acid (ACCELERATOR) | 0.3 parts by weight |
| N—cyclohexyl sulfamic acid (ACCELERATOR) | 1.3 parts by weight |

A phosphating solution intended for spray-coating was prepared from both concentrates by dissolving 20.0 g/l of concentrate A and 60.0 g/l of concentrate B in water. The number of total acid points titrated on a 10 ml bath sample with 0.1N sodium hydroxide solution against phenol phthalein was 29. The free acid points determined by titrating a 10 ml bath sample with 0.1N sodium hydroxide solution against bromcresol green was 0.8.

Cold-rolled steel plates were subjected to the following treatments: First, the plates were sprayed for 60s at 55° C. with an alkaline cleaner based on sodium orthophosphate, sodium pyrophosphate, activating titanium salt and surfactant, followed by rinsing with cold water for 30s.

The plates were then treated with the above-described phosphating solution by spraying for 90s at 55° C. The phosphated plates were cold-rinsed for 30s and then spray-treated for 30s at room temperature with a solution containing Cr(VI)/Cr(III) ions and having a pH-value of 4.0. This was followed by spray-rinsing for 10s with fully deionized water, after which the plates were oven-dried for 5 minutes at 130° C.

The plates thus treated were then subjected to cathodic electrodeposition with an electrodeposition lacquer. The test to determine corrosion resistance and various other physical properties produced excellent results.

EXAMPLE 4

A concentrate A was prepared by mixing the following ingredients in a container of stainless steel:

| | |
|---|---|
| water | 30.7 parts by weight |
| $H_3PO_4$ (75%) | 56.7 parts by weight |
| ZnO | 6.8 parts by weight |
| $Ni(NO_3)_2.6H_2O$ | 3.7 parts by weight |
| $FeSO_4.7H_2O$ | 0.2 parts by weight |
| NaOH (50%) | 7.4 parts by weight |
| $NaClO_3$ | 4.5 parts by weight |

In a second container, the following components were stirred together to form a concentrate B and adjusted to pH 3.5 with 50% aqueous NaOH:

| | |
|---|---|
| amidosulfonic acid (ACCELERATOR) | 5.0 parts by weight |
| sodium salt of N—cyclohexyl sulfamic acid (ACCELERATOR) | 20.0 parts by weight |
| water | 75.0 parts by weight |

A phosphating solution intended for spraying was prepared from both concentrates by dissolving 18.0 g of concentrate A and 4.0 g of concentrate B in 1 liter of water. The free acid determined by titrating 10 ml of the bath solution with 0.1N sodium hydroxide solution against bromcresol green amounted to 0.5 point.

Galvanized steel plates were subjected to the treatments described in Example 3 using the phosphating solution described above.

The plates thus treated were subjected to cathodic electrodeposition with an electrodeposition lacquer. The tests to determine corrosion resistance and various other physical properties produced excellent results.

EXAMPLE 5

A concentrate A was prepared by stirring the following constituents together in a powder mixer:

| | |
|---|---|
| NaOH | 36.0 parts by weight |
| $Na_2CO_3$ (calcined) | 20.0 parts by weight |
| waterglass ($Na_2O:SiO_2$ = 1:3.4) | 33.0 parts by weight |
| $Na_3PO_4$ (calcined) | 5.0 parts by weight |
| alkane sulfonate | 3.0 parts by weight |
| Na—cresyl benzene sulfonate | 2.0 parts by weight |
| nonyl phenol 12 EO | 1.0 parts by weight |

A concentrate B was prepared by mixing the following constituents together in a container of plastic or stainless steel:

| | |
|---|---|
| water | 28.0 parts by weight |
| ZnO | 12.0 parts by weight |
| $H_3PO_4$ (75%) | 42.5 parts by weight |
| $HNO_3$ (62%) | 13.0 parts by weight |
| glycerophosphate | 4.5 parts by weight |

In a plastic container, concentrate A was diluted with water to a concentration of 3%, followed by the addition of 0.5% of oxalic acid. An immersion solution I suitable for cleaning and activation was obtained in this way.

A phosphating solution II intended for immersion was prepared from concentrate B by mixing 2.3 g/l of concentrate B, 1.0 g/l of $Zn(NO_3)_2$, 0.2 g/l of amidosulfonic acid and 0.8 g/l of N-cyclohexyl sulfamic acid (ACCELERATORS) in water.

Cold-rolled steel plates were initially treated for 2 minutes at room temperature in immersion solution I and, to form the phosphate coating, were then immersed for 40 seconds at 50° C. in phosphating solution II, followed by rinsing with cold water for 30s.

The plates thus treated were primed with an epoxy immersion lacquer and then tested to determine corrosion resistance and various other physical properties. The results obtained were all excellent.

EXAMPLE 6

The powder-form mixture described in Example 2 was initially prepared and was then dissolved in water in a concentration of 12.0 g/l. 1.5 g/l of benzene sulfanilide (ACCELERATOR) was then added to the resulting solution. Using the solution thus prepared in this way, galvanized steel plates were cleaned, degreased and spray-coated with a phosphate layer in a single operation carried out at 50° C. The treatment time was 120s.

After rinsing with cold water for 30s, the plates were sprayed for 30 seconds at room temperature with a solution containing Cr(VI)/Cr(III) ions. Thereafter, the plates were spray-rinsed for 10s with fully deionized water and then oven-dried for 5 minutes at 130° C. The plates thus treated were lacquered with a powder lacquer and then tested to determine corrosion resistance and lacquer adhesion. The results obtained were all excellent.

EXAMPLE 7

A concentrate A was initially prepared by mixing the following ingredients in a plastic container:

| | |
|---|---|
| water | 35.0 parts by weight |
| ZnO | 11.0 parts by weight |
| $H_3PO_4$ (75%) | 35.0 parts by weight |
| $HNO_3$ (62%) | 4.6 parts by weight |
| $Ni(NO_3)_2.6H_2O$ | 10.0 parts by weight |
| HF (70%) | 1.2 parts by weight |
| $HBF_4$ (49%) | 3.2 parts by weight |

In a second container, a concentrate B was prepared by stirring the following ingredients together:

| | |
|---|---|
| water | 74.0 parts by weight |
| $NaF_2$ | 1.0 parts by weight |
| amidosulfonic acid (ACCELERAIOR) | 1.0 parts by weight |
| N—cyclohexyl sulfamic acid (ACCELERATOR) | 4.0 parts by weight |
| NaOH | 20.0 parts by weight |

A phosphating solution intended for spraying was prepared from both concentrates by dissolving 20.0 g/l of concentrate A and 20.0 g/l of concentrate B in water.

Aluminium plates were subjected to the following treatments:

First, the plates were sprayed for 60s at 50° C. with an alkaline cleaner based on sodium hydroxide, sodium carbonate, waterglass and surfactant, followed by rinsing with cold water for 30s. The plates were then sprayed for 90s at 55° C. with the phosphating solution prepared as described above.

After rinsing with cold water for 30s, the plates were sprayed for 30s at room temperature with a solution containing Cr(VI)/Cr(III) ions which had a pH of 4. Thereafter, the plates were spray-rinsed for 10s with fully deionized water and then oven-dried for 5 minutes at 130° C. The plates thus treated were lacquered with a powder lacquer and then tested to determine corrosion resistance and lacquer adhesion. The results obtained were all excellent.

EXAMPLE 8

A concentrate A was first prepared by mixing the following ingredients in a container of plastic or stainless steel:

| | |
|---|---|
| water | 25.0 parts by weight |
| $H_3PO_4$, 75% | 55.0 parts by weight |
| ZnO | 12.8 parts by weight |
| $NaClO_3$ | 6.8 parts by weight |
| $Ni(NO_3)_2.6H_2O$ | 0.2 parts by weight |
| $FeSO_4.7H_2O$ | 0.2 parts by weight |

In a second container, a concentrate B was produced by stirring the following ingredients together:

| | |
|---|---|
| N—cyclohexyl sulfamic acid (ACCELERATOR) | 6.0 parts by weight |
| $NaClO_3$ | 15.0 parts by weight |
| NaOH | 3.0 parts by weight |
| water | 76.0 parts by weight |

A phosphating solution intended for spray treatment was prepared from both concentrates by dissolving 30 g/l of concentrate A and 20 g/l of concentrate B in water. The number of total acid points titrated on a 10 ml bath sample with 0.1 N sodium hydroxide solution against phenol phthalein was 14. The free acid, determined by the titration of a 10 ml bath sample with 0.1 N sodium hydroxide solution against bromcresol green, amounted to 0.7.

Cold-rolled steel plates were subjected to the following sequence of operations:

First, the plates were spray treated for 25 seconds at 55° C. with an alkaline cleaner (based on sodium hydroxide, pentasodium tripolyphosphate and surfactant). They were then subjected to a second spray cleaning operation using an alkaline cleaner (based on disodium hydrogen phosphate, activating titanium salt and surfactant) for 25 seconds at 45° C., followed by rinsing with cold water for 25 seconds.

The plates were then treated with the phosphating solution described above by spraying for 60 seconds at 55° C. The phosphated plates were cold-rinsed for 25 seconds and then sprayed for 30 seconds at 30° C. with a solution containing CR(VI)/Cr(III) ions (pH 4.0). After rinsing for 10 seconds with fully deionized water, the plates were finally oven-dried for 4 minutes at 110° C.

The plates thus treated were then coated by cathodic electrodeposition using an electrodeposition lacquer. The tests to determine resistance to corrosion and various other physical properties produced excellent results.

EXAMPLE 9

A concentrate A was first prepared by mixing the following ingredients in a container of plastic or stainless steel:

| | |
|---|---|
| water | 25.0 parts by weight |
| $H_3PO_4$, 75% | 55.0 parts by weight |
| ZnO | 12.8 parts by weight |
| $NaClO_3$ | 6.8 parts by weight |
| $Ni(NO_3)_2.6H_2O$ | 0.2 part by weight |
| $FeSO_4.7H_2O$ | 0.2 part by weight |

In a second container, a concentrate B was prepared by stirring the following ingredients together:

| | |
|---|---|
| N—cyclohexyl sulfamic acid (ACCELERATOR) | 12.0 parts by weight |
| $NaClO_3$ | 20.0 parts by weight |
| water | 68.0 parts by weight |

A phosphating solution intended for immersion treatment was prepared from the concentrates by dissolving 45 g/l of concentrate A and 10 g/l of concentrate B in water. The number of total acid points titrated on a 10 ml bath sample with 0.1 N sodium hydroxide solution against phenol phthalein was 25. The free acid, determined by the titration of a 10 ml bath sample with 0.1 N sodium hydroxide solution against bromcresol green, amounted to 1.9.

Cold-rolled steel plates were subjected to the following sequence of operations.

First, the plates were immersed for 10 minutes at 70° C. in an alkaline cleaner (based on sodium hydroxide, waterglass, sodium orthophosphate and surfactant), followed by rinsing with water for 3 minutes. The plates were then pickled for 25 minutes at 25° C. with a pickle containing hydrochloric acid. This was followed by treatment with the phosphating solution described above by immersion for 10 minutes at 50° C. The phosphated plates were rinsed with water for 3 minutes, immersed for 3 minutes at 40° C. in a solution containing CR (VI)/CR(III) ions (pH 4.0) and finally rinsed for 2 minutes with fully deionized water.

The plates thus treated were coated by cathodic electrodeposition using an electrodeposition lacquer. The phosphated and lacquered plates were then subjected to the tests for determining resistance to corrosion and other physical properties. The results obtained were all excellent.

EXAMPLE 10

A concentrate A was first prepared by mixing the following ingredients together in a container of plastic or stainless steel:

| | |
|---|---|
| water | 30.6 parts by weight |
| ZnO | 9.0 parts by weight |
| $CaCO_3$ | 8.0 parts by weight |
| $H_3PO_4$, 75% | 30.0 parts by weight |
| $HNO_3$, 62% | 26.0 parts by weight |
| (less $CO_2$-loss | 3.6 parts by weight |

In a second container, a concentrate B was prepared by stirring the following ingredients together:

| | |
|---|---|
| benzoic acid sulfimide (ACCELERATOR) | 16.0 parts by weight |
| sodium hydroxide | 15.0 parts by weight |
| sodium nitrite | 1.0 parts by weight |
| water | 68.0 parts by weight |

A phosphating solution intended for spraying was prepared from the two concentrates by dissolving 25 g/l of concentrate A and 5 g/l of concentrate B in water. The number of total acid points, titrated on a 10 ml bath sample with 0.1 N sodium hydroxide solution against phenol phthalein, was 14, the free acid, determined by the titration of 10 ml bath sample with 0.1 N sodium hydroxide solution against bromcresol green, amounted to 0.8.

Cold-rolled steel plates were subjected to the following sequence of operations:

First, the plates were sprayed or 25 seconds at 55° C. with an alkaline cleaner (based on sodium hydroxide, pentasodium tripolyphosphate and surfactant). The plates were then sprayed for 25 seconds at 45° C. with a second alkaline cleaner (based on disodium hydrogen phosphate, activating titanium salt and surfactant), followed by rinsing with cold water for 25 seconds. The plates were then treated with the phosphating solution described above by spraying for 50 seconds at 55° C. The phosphated plates were rinsed with cold water for 25 seconds and then sprayed for 25 seconds at 30° C. with a solution containing Cr(VI)/Cr(III) ions (pH 4.0). After spray-rinsing with fully deionized water for 10 seconds, the plates were finally oven-dried for 4 minutes at 110° C.

The plates thus treated were coated by cathodic electrodeposition using an electrodeposition lacquer. The tests for determining resistance to corrosion and various other physical properties produced excellent results.

EXAMPLE 11

A concentrate A was first prepared by mixing the following ingredients in a container of plastic or stainless steel:

| | |
|---|---|
| $(NH_4)H_2PO_4$ | 22.0 parts by weight |
| $Ca(NO_3)_2 \cdot 4H_2O$ | 1.5 parts by weight |
| sulfamic acid | 0.5 part by weight |
| N—cyclohexyl sulfamic acid (ACCELERATOR) | 1.2 parts by weight |
| water | 74.8 parts by weight |

In a second container, a concentrate B was prepared by stirring the following ingredients together:

| | |
|---|---|
| ethylene diamine, 30 E.O., 60 P.O. | 24.0 parts by weight |
| alkylphenol, 10 E.O., 9 P.O. | 14.0 parts by weight |
| cocoamine, 12 E.O. | 4.0 parts by weight |
| water | 58.0 parts by weight |

(E.O. = ethylene oxide; P.O. = propylene oxide)

A solution intended for spraying was prepared from the two concentrates by dissolving 20 g/l of concentrate A and 3 g/l of concentrate B in water. The resulting solution has a pH of 5.2.

Cold-rolled steel plates were spray-cleaned with the solution thus prepared, degreased and coated with a conversion layer in a single operation carried out over a period of 180 seconds at a temperature of 55° C. The plates were then spray-rinsed with cold water for 30 seconds at 25° C. and subsequently sprayed for 30 seconds at 45° C. with a solution containing Cr(VI)/Cr(III) ions (pH 4.0). After spray-rinsing with fully deionized water for 15 seconds, the plates were finally ovendried for 5 minutes at 80° C.

The plates thus treated were coated by cathodic electrodeposition with an electrodeposition lacquer. The tests for determining resistance to corrosion and various other physical properties produced excellent results.

EXAMPLE 12

The two concentrates A and B described in Example 11 were prepared. A solution intended for spray treatment was prepared from these two concentrates by dissolving 10 g/l of concentrate A and 2 g/l of concentrate B in water. The resulting solution has a pH of 5.7.

Galvanized steel plates were sprayed for 6 seconds at 55° C. with the solution thus prepared and then rinsed for 10 seconds with fully deionized water and dried. A visible layer was immediately formed on the metal surface.

The galvanized steel plates thus treated were knife-coated with a coil coating lacquer. They were then subjected to the tests for determining resistance to corrosion and lacquer adhesion. The results obtained were excellent.

EXAMPLE 13

Concentrate A of Example 11 was made up into a solution intended for spray treatment by dissolution in water (10 g/l of concentrate A). The resulting solution has a pH of 5.7.

Galvanized steel plates were treated as follows with the solution thus prepared:

First, the galvanized steel plates were sprayed for 10 seconds at 55° C. with a cleaner based on sodium hydroxide, sodium gluconate and surfactant. The plates were then spray-rinsed for 20 seconds with cold water and subsequently treated with the solution in question by spraying for 6 seconds at 55° C. The plates were then spray-rinsed with cold water for 30 seconds at 25° C. and subsequently sprayed for 30 seconds at 45° C. with a solution containing Cr(VI)/Cr(III) ions (pH 4.0). After rinsing with fully deionized water for 10 seconds, the plates were finally dried.

The galvanized steel plates treated as described in the foregoing clearly showed a conversion layer and were knife-coated with a coil coating lacquer. The tests for determining resistance to corrosion and various other physical properties produced excellent results.

EXAMPLE 14

A concentrate A was initially prepared by mixing the following ingredients in a container of plastic or stainless steel:

| | |
|---|---|
| water | 25.0 parts by weight |
| $H_3PO_4$, 75% | 55.0 parts by weight |
| ZnO | 12.8 parts by weight |
| $NaClO_3$ | 6.8 parts by weight |
| $Ni(NO_3)_2.6H_2O$ | 0.2 part by weight |
| $FeSO_4.7H_2O$ | 0.2 part by weight |

In a second container, a concentrate B was prepared by stirring the following ingredients together:

| | |
|---|---|
| N—cyclohexyl sulfamic acid, Na—salt (ACCELERATOR) | 5.0 parts by weight |
| m-nitrobenzene sulfonic acid-Na—salt (ACCELERATOR) | 1.0 part by weight |
| $NaClO_3$ | 15.0 parts by weight |
| NaOH | 3.0 parts by weight |
| water | 76.0 parts by weight |

A phosphating solution intended for spraying was prepared from both concentrates by dissolving 30 g/l of concentrate A and 20 g/l of concentrate B in water. The number of total acid points titrated on a 10 ml bath sample with 0.1 N sodium hydroxide solution against phenol phthalein was 14. The free acid, determined by the titration of a 10 ml bath sample with 0.1 N sodium hydroxide solution against bromcresol green, amounted to 0.7.

Cold-rolled steel plates were subjected to the following sequence of operations:

First, the plates were sprayed for 25 seconds at 55° C. with an alkaline cleaner (based on sodium hydroxide, pentasodium tripolyphosphate and surfactant). The plates were then sprayed for 25 seconds at 45° C. with a second alkaline cleaner based on disodium hydrogen phosphate, activating titanium salt and surfactant, followed by rinsing with cold water for 25 seconds.

The plates were then treated with the phosphating solution described above by spraying for 60 seconds at 55° C. The phosphated plates were cold-rinsed for 25 seconds and then sprayed for 30 seconds at 30° C. with a solution containing CR(VI)/Cr(III) ions (pH 4.0). After rinsing for 10 seconds with fully deionized water, the plates were finally oven-dried for 4 minutes at 110° C.

The plates thus treated were then coated by cathodic electrodeposition using an electrodeposition lacquer. The tests for determining resistance to corrosion and various other physical properties produced excellent results.

EXAMPLE 15

A concentrate A was first prepared by mixing the following ingredients in a container of plastic or stainless steel:

| | |
|---|---|
| water | 32.2 parts by weight |
| $H_3PO_4$, 75% | 47.5 parts by weight |
| ZnO | 8.0 parts by weight |
| $NiCO_3$ | 5.6 parts by weight |
| NaOH, 50% | 1.4 parts by weight |
| $FeSO_4.7H_2O$ | 0.2 part by weight |
| $NaClO_3$ | 4.6 parts by weight |

In a second container, a concentrate B was prepared by stirring the following ingredients together:

| | |
|---|---|
| water | 44.5 parts by weight |
| $H_3PO_4$, 7% | 31.3 parts by weight |
| $NiCO_3$ | 5.6 parts by weight |
| NaOH, 50% | 14.0 parts by weight |
| $NaClO_3$ | 3.0 parts by weight |
| 1,2,3-oxathiazin-4(3H)—one potassium (ACCELERATOR) | 1.6 parts by weight |

A phosphating solution intended for spraying was prepared from the two concentrates by dissolving 20.0 g/l of concentrate A and 60.0 g/l of concentrate B in water. The number of total acid points titrated on a 10 ml bath sample with 0.1 N sodium hydroxide solution against phenol phthalein was 29. The free acid, determined by the titration of a 10 ml bath sample with 0.1 N sodium hydroxide solution against bromcresol green, amounted to 0.8.

Cold-rolled steel plates were subjected to the following sequence of operations:

First, the plates were sprayed for 60 seconds at 55° C. with an alkaline cleaner based on sodium orthophosphate, sodium pyrophosphate, activating titanium salt and surfactant, followed by rinsing with cold water for 30 seconds.

The plates were then treated with the phosphating solution described above by spraying for 90 s at 55° C. The phosphated plates were cold-rinsed for 30 s and subsequently sprayed for 30 s at room temperature with a solution containing CR(VI)/Cr(III) ions (pH 4.0).

After spray-rinsing for 10 s with fully deionized water, the plates were oven-dried for 5 minutes at 130° C.

The plates thus treated were then coated by cathodic electrodeposition using an electrodeposition lacquer. The tests for determining resistance to corrosion and various other physical properties produced excellent results.

EXAMPLE 16

A concentrate was initially prepared by mixing the following ingredients in a container of plastic or stainless steel:

| | |
|---|---|
| water | 34.7 parts by weight |
| $H_3PO_4$, 75% | 46.0 parts by weight |
| ZnO | 8.5 parts by weight |
| $NiCO_3$ | 5.6 parts by weight |
| NaOH, 50% | 5.0 parts by weight |
| $FeSO_4.7H_2O$ | 0.2 part by weight |

In a second container, a concentrate B was prepared by stirring the following ingredients together:

| | |
|---|---|
| water | 44.7 parts by weight |
| $H_3PO_4$, 75% | 32.0 parts by weight |
| NaOH, 50% | 20.0 parts by weight |
| $NiCO_3$ | 0.3 part by weight |
| N—cyclohexyl sulfamic acid (ACCELERATOR) | 8.0 parts by weight |

A phosphating solution intended for spraying was prepared from the two concentrates by dissolving 30.0 g/l of concentrate A and 45 g/l of concentrate B in water. The number of total acid points titrated on a 10 ml bath sample with 0.1 N sodium hydroxide solution against phenol phthalein was 29. The free acid, determined by the titration of a 10 ml bath sample with 0.1 N sodium hydroxide solution against bromcresol green, amounted to 0.8.

Cold-rolled steel plates were subjected to the following sequence of operations:

First, the plates were sprayed for 60 s at 55° C. with an alkaline cleaner based on sodium orthophosphate, sodium pyrophosphate, activating titanium salt and surfactant, followed by rinsing with cold water for 30 s.

The plates were then treated with the phosphating solution described above by spraying for 90 s at 55° C. The phosphated plates were cold-rinsed for 30 s and then sprayed for 30 s at room temperature with a solution containing CR(VI)/Cr(III) ions at a pH of 4.0.

After spray-rinsing for 10 s with fully deionized water, the plates were oven-dried for 5 minutes at 130° C.

The plates thus treated were then coated by cathodic electrodeposition using an electrodeposition lacquer. The tests for determining resistance to corrosion and various other physical properties produced excellent results.

EXAMPLE 17

A concentrate was prepared by mixing the following ingredients in a container of stainless steel:

| | |
|---|---|
| water | 30.0 parts by weight |
| $H_3PO_4$, 75% | 45.0 parts by weight |
| ZnO | 14.5 parts by weight |
| $HNO_3$, 62% | 10.0 parts by weight |
| $Ni(NO_3)_2.6H_2O$ | 0.5 part by weight |

A phosphating solution intended for immersion was prepared from this concentrate by dissolving 40 g/l of the concentrate and 2 g/l of the sodium salt of N-cyclohexyl sulfamic acid (ACCELERATOR) in water. The number of total acid points titrated on a 10 ml bath sample with 0.1 N sodium hydroxide solution against phenol phthalein was 40. The free acid, determined by the titration of a 10 ml bath sample with 0.1 N sodium hydroxide solution against bromcresol green, amounted to 2.0.

For cold forming (gearwheel manufacture), round steel blanks were subjected to the following sequence of operations:

First, the blanks were treated with an alkaline cleaner (based of sodium hydroxide, waterglass, sodium carbonate, sodium orthophosphate and surfactant) by immersion therein for 10 minutes at 70° C., followed by rinsing with water for 3 minutes. The blanks thus treated were then pickled for 10 minutes at 25° C. with an inhibited pickle containing sulfuric acid, followed by rinsing with water for another 3 minutes. The blanks were then treated with the phosphating solution described above by immersion for 8 minutes at 50° C., this treatment producing a layer weight of 15 g per square meter.

The phosphated blanks were rinsed with water for 3 minutes and then treated for 5 minutes at 80° C. with a soap-containing aqueous solution (6% of sodium stearate, 1% of sodium myristate).

Gearwheels were produced from the blanks thus treated.

EXAMPLE 18

A concentrate was prepared by mixing the following ingredients in a container of stainless steel:

| | |
|---|---|
| water | 45.6 parts by weight |
| $H_3PO_4$, 75% | 22.0 parts by weight |
| ZnO | 12.0 parts by weight |
| $HNO_3$, 62% | 20.5 parts by weight |

A phosphating solution intended for immersion was prepared from this concentrate by dissolving 80 g/l of the concentrate and 3 g/l of the sodium salt of N-cyclohexyl sulfamic acid (ACCELERATOR) in water. The number of total acid points titrated on a 10 ml bath sample with 0.1 N sodium hydroxide against phenol phthalein was 30. The free acid, determined by the titration of a 10 ml bath sample with 0.1 N sodium hydroxide solution against bromcresol green, amounted to 1.8.

For cold forming (gearwheel manufacture), round steel blanks were subjected to the following sequence of operations:

First, the blanks were treated with an alkaline cleaner (based on sodium hydroxide, waterglass, sodium orthophosphate and surfactant) by immersion therein for 10 minutes at 75° C., followed by rinsing with water for 3 minutes. The blanks were then pickled for 10 minutes at 30° C. with an inhibited pickle containing sulfuric acid, followed by rinsing with water for another 3 minutes. The blanks were then treated with the phosphating solution described above by immersion for 5 minutes at 50° C. This treatment produced a layer weight of 25 $g/m^2$.

The phosphated blanks were rinsed with water for 3 minutes and then treated for 5 minutes at 80° C. with a soap-containing aqueous solution (6% of sodium stearate, 1% of sodium myristate).

Gearwheels were made from the blanks thus treated.

EXAMPLE 19

A concentrate A was first prepared by mixing the following ingredients in a container of plastic or stainless steel:

| | |
|---|---|
| water | 25.0 parts by weight |
| $H_3PO_4$, 75% | 55.0 parts by weight |
| ZnO | 12.8 parts by weight |
| $NaClO_3$ | 6.8 parts by weight |
| $Ni(NO_3)_2.6H_2O$ | 0.2 part by weight |
| $FeSO_4.7H_2O$ | 0.2 part by weight |

In a second container, a concentrate B was prepared by stirring the following ingredients together:

| | |
|---|---|
| 3-toluidine-4-sulfonic acid (ACCELERATOR) | 25.0 parts by weight |
| $NaClO_3$ | 15.0 parts by weight |
| water | 60.0 parts by weight |

A phosphating solution intended for immersion was prepared from the two concentrates by dissolving 45 g/l of concentrate A and 10 g/l of concentrate B in water. The number of total acid points titrated on a 10 ml bath sample with 0.1 N sodium hydroxide solution against phenol phthalein was 25. The free acid, determined by the titration of a 10 ml bath sample with 0.1 N sodium hydroxide solution against bromcresol green, amounted to 1.9.

Cold-rolled steel plates were subjected to the following sequence of operations:

First, the plates were treated with an alkaline cleaner (based on sodium hydroxide, waterglass, sodium orthophosphate and surfactant) by immersion therein for 10 minutes at 70° C., followed by rinsing with water for 3 minutes. The plates were then pickled for 25 minutes at 25° C. with a pickle containing hydrochloric acid. This was followed by treatment with the phosphating solution described above by immersion therein for 10 minutes at 50° C. The phosphated plates were rinsed with water for 3 minutes and then treated with a solution containing Cr(VI)/Cr(III) ions (pH 4.0) by immersion therein for 3 minutes at 40° C. Finally, the plates were rinsed for 2 minutes with fully deionized water.

The plates thus treated were coated by cathodic electrodeposition with an electrodeposition lacquer. The phosphated and lacquered plates were then subjected to the tests for determining resistance to corrosion and various other physical properties. The results obtained were all excellent.

We claim:

1. A phosphating composition for zinc-, iron-, or zinc-iron-phosphate conversion coatings, excluding nitrite as an accelerator, and containing an accelerator which is one of the following compounds, its alkali metal salt or ammonium salt, or any mixture thereof:

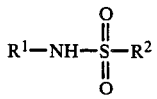

(I)

wherein:

$R^1$ is (i) a $C_{1-4}$ linear or branched alkyl radical, (ii) a $C_{5-6}$ saturated carbocyclic or heterocyclic radical, or (iii) an aryl or aralkyl radical having at least 6 members; and $R^2$ is (i) hydroxy, (ii) $—O^-M^+$ in which $N^+$ is an alkali metal or an ammonium ion, of (iii) an aromatic ring having at least 6 members, optionally substituted by a hydroxy, amino, ($C_{1-3}$ alkyl)—CO—NH or (carboxy $C_{1-3}$ alkyl-)—CO—NH radical;

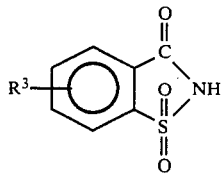

(II)

wherein, $R^3$ is (i) hydrogen, (ii) hydroxy, or (iii) anamino radical;

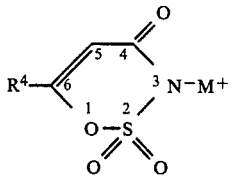

(III)

wherein:

$R^4$ is (i) hydrogen, or (ii) a $C_{1-4}$ linear or branched alkyl radical and $M^+$ is an alkali metal or an ammonium ion.

2. The composition of claim 1 wherein said compounds are, N-cyclohexyl sulfamic acid or salts thereof, benzoic acid sulfimide, sulfanilide, 1,2,3-oxathiazin-4-(3H)-one salts or 6-alkyl derivatives thereof.

3. The composition of claim 1 wherein said compounds are N-cyclohexyl sulfamic acid or salts thereof, benzoic acid sulfimide, sulfanilide, 1,2,3-oxathiazin-4-(3H)-one potassium or 6-alkyl derivatives thereof.

4. The composition of claim 1 wherein said accelerator is:

(a) amidosulfonic acid and N-cyclohexyl sulfamic acid (b) amidosulfonic acid and N-cyclohexyl sulfamic acid sodium salt, (c) benzene sulfanilide, (d) N-cyclohexyl sulfamic acid, (e) benzoic acid sulfimide, (f) N-cyclohexyl sulfamic acid sodium salt and m-nitrobenzene sulfonic acid sodium salt, (g) 1,2,3-oxathiazin-4(3H)-one potassium salt (h) N-cyclohexyl sulfamic acid sodium salt.

5. The composition of claim 1 wherein said accelerator composition is the N-substitution product of amidosulfonic acid, its salt, or a mixture thereof; a chlorate is present as an auxiliary accelerator; and the weight ratio of accelerator composition to auxiliary accelerator is about 0.1–10.0:1.

6. The composition of claim 1 wherein said accelerator composition is sulfonamide; a chlorate is present as an auxiliary accelerator; and the weight ratio of accelerator composition to auxiliary accelerator is about 0.1–10.0:1.

7. The composition of claim 1 wherein said accelerator composition is aminosulfonic acid, its N-substitution product, its salt, or a mixture thereof; a molybdate is present as an auxiliary accelerator; and the weight ratio of accelerator composition to auxiliary accelerator is 10–100:1.

8. The composition of claim 1 wherein said accelerator composition is 6-methyl-1,2,3-oxathiazin-4(3H)-one potassium salt.

9. The composition of claim 1 wherein $R^2$ is (ii) or (iii).

10. In a process for the accelerated and layer-refining application of phosphate coatings to metal surfaces using phosphating solutions based on zinc phosphate and/or iron phosphate and/or zinc-iron phosphate as the principal layer-forming component, in admixture with an accelerator, excluding nitrite the improvement comprising using as the accelerator a composition consisting essentially of one of the following compounds, its alkali metal salt or ammonium salt, or any mixture thereof:

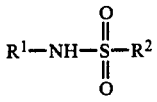

(I)

wherein:

$R^1$ is, (i) a $C_{1-4}$ linear or branched alkyl radical, (ii) a $C_{5-6}$ saturated carbocyclic or heterocyclic radical, or (iii) an aryl or aralkyl radical having at least 6 members; and $R^2$ is (i) hydroxy, (ii) $—O^-M^+$ in which $M^+$ is an alkali metal or an ammonium ion, or (iii) an aromatic ring having at least 6 members, optionally substituted by a hydroxy, amino, ($C_{1-3}$ alkyl)—CO—NH or (carboxy $C_{1-3}$ alkyl-)—CO—NH radical;

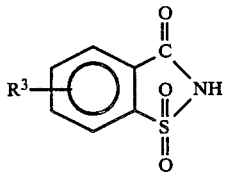

(II)

wherein:

$R^3$ is (i) hydrogen, (ii) hydroxy, or (iii) an amino radical;

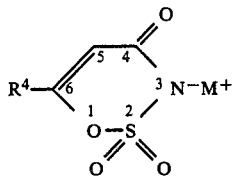

(III)

wherein:

$R^4$ is (i) hydrogen, or (ii) a $C_{1-4}$ linear or branched alkyl radical, and $M^+$ is an alkali metal or an ammonium ion.

11. The process of claim 10 wherein said accelerator is present in said phosphating solution in an amount effective to accelerate deposition of a phosphate coating at a given solution temperature.

12. The process of claim 11 wherein said accelerator is present in from about 0.1 to 6 grams per liter of phosphating solution.

13. The process of claim 12 wherein said accelerator composition is the N-substitution product of amidosulfonic acid, its salt, or a mixture thereof.

14. The process of claim 13 wherein a chlorate is present as an auxiliary accelerator.

15. The process of claim 14 wherein the weight ratio of accelerator composition to auxiliary accelerator is about 0.1–10.0:1.

16. The process of claim 12 wherein said accelerator composition is a sulfonamide.

17. The process of claim 16 wherein a chlorate is present as an auxiliary accelerator.

18. The process of claim 17 wherein the weight ratio of accelerator composition to auxiliary accelerator is about 0.1–10.0:1.

19. The process of claim 12 wherein said accelerator is aminosulfonic acid, its N-substitution product, its salt, or a mixture thereof.

20. The process of claim 19 wherein a molybdate is present as an auxiliary accelerator.

21. The process of claim 20 wherein the weight ratio of accelerator composition to auxiliary accelerator is 10–100:1.

22. The process of claim 12 wherein said accelerator is 6-methyl-1,2,3-oxathiazin-4(3H)-one potassium salt.

23. The process of claim 10 wherein $R^2$ is (ii) or (iii).

24. The process of claim 10 wherein said phosphating solution additionally contains at least one of (a) from about 0.3 to 5.0 grams per liter of a mixture of nonionic surfactants, (b) from about 0.1 to 5.0 grams per liter of simple fluorides, complex fluorides, or their mixture, and (c) $Ni^-$ ions, $Co^-$ ions, $Fe^-$ ions, or their mixture.

25. The process of claim 24 wherein the total amount of said phosphating solution additional constituents is about 0.1 to 4.5 grams per liter.

26. The process of claim 10 wherein the pH of said phosphating solution is about 1.8 to 5.8.

27. The process of claim 10 wherein the pH of said phosphating solution is about 2.0 to 3.5.

28. The process of claim 10 wherein the temperature of said phosphating solution at the time of treatment is about 25 to 70° C.

29. The process of claim 10 wherein the temperature of said phosphating solution at the time of treatment is about 45° to 60° C.

30. The process of claim 10 wherein the treatment time with said phosphating solution is about 20 to 300 seconds.

31. The process of claim 10 wherein the treatment time with said phosphating solution is about 30 to 180 seconds.

32. The process of claim 10 wherein the pH of said phosphating solution is about 2.0 to 3.5; the temperature of said phosphating solution at the time of treatment is about 45° to 60° C.; and the treatment time with said phosphating solution is about 30 to 180 seconds.

33. The process of claim 10 wherein said application of phosphate coatings is by immersion, spraying, or a combination thereof.

34. The process of claim 10 wherein said compounds are, N-cyclohexyl sulfamic acid or salts thereof, benzoic acid sulfimide; sulfanilide, 1,2,3-oxathiazin-4-(3H)-one salts or 6-alkyl derivatives thereof.

35. The process of claim 10 wherein said compounds are, N-cyclohexyl sulfamic acid or salts thereof, benzoic acid sulfimide, sulfanilide, 1,2,3-oxathiazin4-(3H)-one potassium or 6-alkyl derivatives thereof.

36. The process of claim 10 wherein said accelerator is:

(a) amidosulfonic acid and N-cyclohexyl sulfamic acid
(b) amidosulfonic acid and N-cyclohexyl sulfamic acid sodium salt,
(c) benzene sulfanilide,
(d) N-cyclohexyl sulfamic acid,
(e) benzoic acid sulfimide,
(f) N-cyclohexyl sulfamic acid sodium salt and m-nitrobenzene sulfonic acid sodium salt,
(g) 1,2,3-oxathiazin-4(3H)-one potassium salt
(h) N-cyclohexyl sulfamic acid sodium salt, or
(i) 3-toluidine-4-sulfonic acid.

* * * * *